US005575452A

United States Patent [19]

Whitby et al.

[11] Patent Number: 5,575,452

[45] Date of Patent: Nov. 19, 1996

[54] BLOWOUT PREVENTER WITH RAM WEDGE LOCKS

[75] Inventors: Melvyn F. Whitby, Houston; Frank L. Sklenka, Kingwood; David L. O'Donnell, Houston, all of Tex.

[73] Assignee: Varco Shaffer, Inc., Houston, Tex.

[21] Appl. No.: 522,998

[22] Filed: Sep. 1, 1995

[51] Int. Cl.[6] ..... E21B 33/06

[52] U.S. Cl. ..... 251/1.3; 92/19; 92/28

[58] Field of Search ..... 251/1.1, 1.3; 92/17, 92/18, 19, 27, 28

[56] References Cited

U.S. PATENT DOCUMENTS

| | | | |
|---|---|---|---|
| 2,632,425 | 3/1953 | Grover | 92/28 |
| 3,050,943 | 8/1962 | Thorel et al. . | |
| 3,242,826 | 3/1966 | Smith . | |
| 3,918,478 | 11/1975 | Le Rouax . | |
| 3,941,141 | 3/1976 | Robert . | |
| 4,188,860 | 2/1980 | Miller . | |
| 4,290,577 | 9/1981 | Olson . | |
| 4,305,565 | 12/1981 | Abbe . | |
| 4,519,571 | 5/1985 | Jones et al. . | |
| 4,601,232 | 7/1986 | Troxell, Jr. . | |
| 4,840,346 | 6/1989 | Adnyana et al. . | |
| 4,969,627 | 11/1990 | Williams, III . | |
| 5,025,708 | 6/1991 | Smith et al. . | |
| 5,056,418 | 10/1991 | Granger et al. | 251/1.1 X |

OTHER PUBLICATIONS

Advertisement: MPL Components by Hydril Mechanical Products Division, 2 pages.

Advertisement: Type "U" Blowout Preventer Features by Cameron Iron Works, Inc. of Houston, Texas, 2 pages.

*Primary Examiner*—John C. Fox

[57] ABSTRACT

A hydraulically controlled ram actuating mechanism 10 for a blowout preventer controls the opening and closing of a ram block 12 interconnected with a ram 14 movable within a ram housing 26 along ram axis 16. The ram piston 24 and a locking piston 62 are each movable within the ram housing in response to fluid pressure. The locking piston includes a plurality of substantially planar tapered locking piston surfaces 72 circumferentially arranged on the exterior of the locking piston and inclined at an acute positive cam angle. A plurality of locking rods 40 are each secured to the ram housing 26 and are circumferentially spaced about the locking piston, with each locking rod including a substantially planar tapered locking rod surface 82 thereon inclined at an acute negative cam angle. A plurality of locking segments 60 are each spaced radially between a locking rod and the locking piston, with each locking segment adapted for being sandwiched between the locking surfaces for preventing opening of the ram until the locking piston is moved in response to fluid pressure. The actuating mechanism reliably controls the flow of well fluids through the blowout preventer and may be automatically locked in an infinite number of locking positions within a wide locking range.

20 Claims, 4 Drawing Sheets

BLOWOUT PREVENTER WITH RAM WEDGE LOCKS

FIELD OF THE INVENTION

The present invention relates to an actuating mechanism for a ram-type blowout preventer. More particularly, this invention relates to an improved blowout preventer which includes a relatively simple and rugged hydraulically operated actuating mechanism for automatically locking the rams of a BOP closed.

BACKGROUND OF THE INVENTION

Locking mechanisms have been used for decades to lock opposing rams of a blowout preventer (BOP) closed. Those familiar with BOP operations recognize the safety advantages of automatically locking the BOP rams closed, ensuring that the BOP rams remain closed even if hydraulic pressure to the BOP is lost or removed, and only allowing the BOP rams to open when hydraulic pressure is intentionally applied to the BOP for the purpose of opening the BOP rams.

Early versions of BOP locking devices included complex locking assemblies with numerous components and biasing springs. One early version of a blowout preventer locking mechanism is disclosed in U.S. Pat. No. 3,242,826. Other locking mechanisms for ram-type blowout preventers are only capable of locking each ram shaft closed in a single locking position. Although various sizes of ram sealing blocks and ram shearing blocks are used for different size oilfield tubulars, BOP locking devices which lock in a single position, such as the devices disclosed in U.S. Pat. Nos. 4,188,860 and 4,519,571, have questionable reliability under many applications. The nominal diameter of the oilfield tubular may vary slightly as a function of tubular manufacturer. The exterior surface of the tubular may have experienced wear or erosion, thereby reducing the outer diameter of the tubular for engagement with the ram sealing block. Packer seal wear on the sealing block head requires proper axial spacing of the ram shaft position to ensure that an effective seal will be made with the oilfield tubular passing through the BOP. Seal wear on the opposing shearing ram blocks also requires different axially spaced ram locking positions to ensure Chat the mating shear rams will seal off high pressure in the wellbore below the rams of the BOP. Using a single locking position actuating mechanism, field adjustments need to be repeatedly made by a trained operator to ensure that the locked position of the ram shaft will provide the desired sealing operation when the BOP was closed.

Other BOP locking mechanisms have included locking dogs or stops which are external to the blowout preventer ram cylinder. An external BOP locking device, as disclosed in U.S. Pat. No. 3,918,478, is no longer widely used. Other BOP ram locking devices include tail rod extensions which move within a locking housing in a direction generally perpendicular to the axis of the ram and the ram housing. U.S. Pat. Nos. 4,601,232 and 4,969,627 each disclose locking mechanisms with a lock housing separate from the ram housing. The added cost and complexity of these designs has reduced their acceptance for many applications.

In recent years, ram locks for blowout preventers which permit locking of the ram shaft in multiple positions have included axially spaced teeth along the ram or along another member which is axially centered with respect to the ram axis. U.S. Pat. No. 4,290,577 discloses a ram lock with multiple locking positions formed by the threads on the surface of a rod. These threaded rod surfaces cooperate with a unidirectional clutch assembly to lock the ram closed in any one of multiple positions. Torque rotates a lock nut, thereby allowing for ram locking in multiple positions. The locking mechanism is automatically set each time the ram is closed, and the locking system maintains the ram closed after hydraulic closing pressure is released. On the application of an opening pressure which releases the clutch mechanism, the locking mechanism opens and allows the ram to open. The mechanism as disclosed in this patent is also complex, and repair and maintenance costs are high.

U.S. Pat. No. 4,840,346 discloses a locking mechanisms which includes axially spaced teeth on the exterior of a central ratchet cylinder. A plurality of flexible finger members are circumferentially spaced about the ratchet cylinder, and are axially fixed with respect to an elongate rod which moves the sealing head into engagement with the oilfield tubular. U.S. Pat. No. 3,941,141 also discloses a locking assembly for locking a ram of a blowout preventer. The central rod includes axially spaced teeth, and a plurality of slip members are brought into locking engagement with the central rod by cooperation between the outer surface on the slip members and the inner surface on a wedge member.

U.S. Pat. No. 5,025,708 discloses a ram locking mechanism which is capable of locking in multiple positions. The assembly includes a plurality of circumferentially spaced locking rods, each having locking teeth for engagement with a respective locking segment. The locking segments are spring biased for engagement with the locking teeth, and may be moved out of engagement with the locking rods by hydraulically controlled movement of an unlocking piston with tapered unlocking fingers. BOP ram locking devices which rely on axially spaced teeth are capable of locking in multiple positions, although the number of locking positions is determined by the axial spacing of the locking teeth. As the teeth are spaced axially closer together, machining costs increase and the number of teeth required to reliably withstand the ram opening pressure increases. The '708 patent minimizes this problem by allowing the teeth on one locking rod to be axially offset with respect to the teeth on another locking rod.

U.S. Pat. No. 4,305,565 discloses a ram lock for a blowout preventer which includes a plurality of wedge members for sandwiching between a tapered interior conical surface on the ram housing and tapered exterior conical surface on a locking cone movable by a piston. This type of locking device also includes numerous components. While the locking device is capable of locking in multiple positions, the varying diameter of the frustoconical surfaces on both the ram housing and the locking cone only ensures that there will be line contact rather than planar surface contact between the wedge member and both the ram housing and the locking cone. When high well pressures are attempting to force the ram to an open position, these forces are concentrated along lines of contact rather than mating planes of contact, thereby creating high stresses and excessive wear between components.

The disadvantages of the prior art are overcome by the present invention, and an improved blowout preventer with wedge ram locks is hereinafter disclosed. The locking mechanism of the blowout preventer as disclosed herein is relatively simple yet rugged, and is highly reliable for locking a ram in an infinite number of locking positions within a broad locking range.

SUMMARY OF THE INVENTION

A blowout preventer includes an improved ram actuating mechanism for the controlling the opening and closing of a ram block or ram head. More particularly, the ram actuating mechanism automatically prevents the opening of the ram block unless hydraulic pressure is applied to the blowout preventer for the specific purpose of unlocking the ram closing mechanism and thereby allowing the opening of the ram block. In an exemplary embodiment, the ram block is a ram sealing block for sealing engagement with an oilfield tubular passing through the BOP. The ram sealing block is mechanically interconnected with a ram or ram shaft which passes through a BOP door and is axially movable within a ram housing along a ram axis between opened and closed position. A ram piston is secured to the ram shaft and axially moves within the ram housing in response to fluid pressure. A locking piston sealingly engages the ram piston and is independently movable in response to fluid pressure with respect to the ram piston along the ram axis.

The locking piston includes a plurality of planar tapered surfaces each inclined at an acute positive locking piston cam angle. A plurality of locking rods are cantilevered within respective locking rod cavities in the ram piston and are fixed to a cylinder head plate of the ram housing. The plurality of locking rods are circumferentially arranged about the locking piston, and each include a planar tapered surface thereon inclined at an acute negative locking rod cam angle. A plurality of locking segments or wedge segments are each movable within the ram housing by engagement with the ram piston. Each of the locking segments becomes sandwiched between a respective planar tapered surface on a locking rod and a corresponding tapered surface on the locking piston to prevent opening of the ram until an unlocking fluid pressure is applied to the locking piston.

Each of the locking rod planar tapered surfaces is inclined at a cam angle of less than 12° with respect to the ram axis and is tapered such that there is an increase in the spacing between the ram axis and the locking rod surface when moving axially toward the ram block. Each of the planar tapered surfaces on the locking piston similarly is inclined at an angle of less than 12° with respect to the locking rod axis, but is tapered in an opposite direction such that the spacing between the ram axis and the locking piston surfaces decreases when moving axially toward the ram block. The outer surface on each of the locking segments is configured for planar engagement with the planar surface on a respective locking rod, and the inner surface of each locking segment is similarly configured for planar engagement with the respective tapered surface on the locking piston. In a preferred embodiment of the invention, four locking rods are circumferentially arranged at 90° about the locking piston, with each locking rod being uniformly spaced from the central ram axis.

It is an object of the present invention to provide an improved actuating mechanism for controlling the operation of a blowout preventer, wherein the actuating mechanism includes a locking mechanism capable of locking the ram block closed in an infinite number of axial positions within a comparatively wide locking range. The blowout preventer may be reliably used with different sized oilfield tubulars within a selected range, and allows the blowout preventer to more reliably seal against a tubular without "backing-off" to a locked position determined by the varying characteristics of the seals in the ram block. The back-off commonly associated with locking mechanism which rely on axially spaced teeth for preventing opening of the ram block is thus avoided by the wedge-type locking mechanism of this invention.

It is another object of the invention to provide a wedge-type ram locking mechanism which is capable of maintaining a ram block closed until fluid pressure is applied to the BOP to move a locking piston and thereby allow the subsequent opening of the ram block. The hydraulically operated locking mechanism is configured to maintain the blowout preventer closed even if fluid closing pressure to the blowout preventer is removed or is unintentionally lost. A related object of the invention is to provide an improved ram locking mechanism which will reduce BOP down-time due to its simplicity and reliability. The operating mechanism of the present invention thus does not rely upon numerous moving parts.

It is a feature of the invention that the actuating mechanism for a blowout preventer preferably utilizes a plurality of circumferentially spaced locking rods each affixed to the ram housing. It is a further feature of the present invention to reduce the complexity of a locking mechanism by providing planar surfaces on each locking rod and corresponding planar surfaces on a locking piston and which cooperate with one of a plurality of locking segments, such that each of the wedge segments is sandwiched between a respective locking rod and the locking piston to prevent the inadvertent opening of the ram block. Each of the tapered surfaces on the locking rods and on the unlocking piston is inclined at an acute angle of less than 12°, and preferably less than about 8°, with respect to the central ram axis. These tapered surfaces are inclined in opposite directions, however, so that the wedge segments becomes trapped between the radially spaced tapered surfaces such that closing fluid pressure on the ram piston and on the locking piston forces the wedge segments more tightly between the tapered surfaces.

It is a significant feature of the present invention that the blowout preventer operating mechanism is rugged and highly reliable, yet the assembly has few moving parts and may be economically manufactured. The planar surfaces on the locking segments thus mate with planar surfaces on a respective locking rod and a corresponding surface on the locking piston to obtain planar contact between engaging surfaces, thereby ensuring the reliable distribution of high forces over a large contact area. It is a related feature of the invention that the locking mechanism of the BOP automatically locks the ram block closed, without using biasing springs or other components to bias the locking segments into a locked position.

A significant advantage of the invention is that the locking mechanism is capable of reliably locking variable bore ram blocks into sealing engagement with oilfield tubulars or with opposing ram blocks. An infinite number of locking positions may be provided within a locking range which is at least 4 cm long. A further advantage of the invention is that the down-time of a BOP is minimized by providing a simple yet rugged actuating mechanism which requires little if any adjustment. It is also an advantage of the invention that the ram operating mechanism may be used to retrofit existing ram-type blowout preventers.

These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
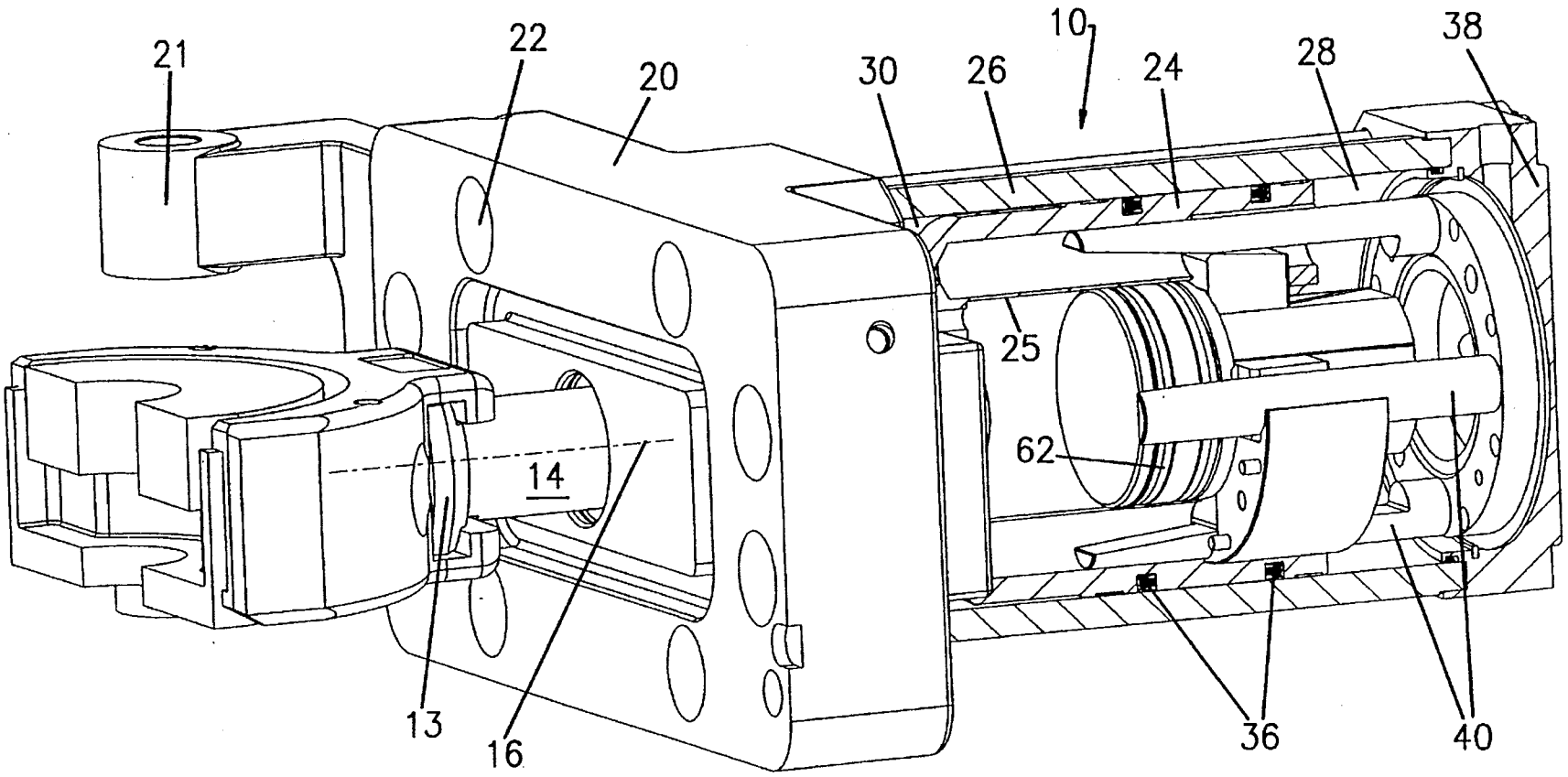
FIG. 1 is a pictorial view of a portion of a blowout preventer according to the present invention, including a ram block, a BOP door, and an actuating mechanism within a ram housing. The actuating mechanism as shown in FIG. 1 is in an intermediate position between an opened and a closed position.

FIG. 1 depicts a portion of a blowout preventer (BOP) including a fluid powered actuator assembly 10 according to the present invention. The BOP conventionally includes an annular body (not shown) having a vertical passageway therethrough for receiving tubular members which pass through the BOP and into a wellbore. Those skilled in the art will appreciate that the BOP body may receive tubular members of various diameters, and conventional ram blocks such as ram block 12 (see FIG. 2) may be interchangeably installed at the end plate 13 of ram 14 for cooperation with different oilfield tubulars within a range of diameters.

A conventional blowout preventer includes two structurally similar and opposing actuator assemblies provided on opposing sides of the BOP body each for engaging an oilfield tubular. The central ram axis 16 of the opposing ram assemblies are thus conventionally coaxial, and pass through and are perpendicular to the central axis of the BOP passageway which receives the vertical oilfield tubulars. Each actuator assembly 10 may be structurally connected by conventional bolt and nut assemblies 18 (see FIG. 2) to a BOP door 20. Each door in turn may be secured to the BOP body by similar threaded members (not shown) passing through respective apertures 22 in the door 20. Each assembly as shown in FIG. 1 may be pivotably mounted on the BOP body by upper and lower arms 21, thereby facilitating repair and maintenance of the ram blocks. The BOP assembly thus includes opposing actuators which are simultaneously activated so that the ram blocks or shear blocks simultaneously close off fluid flow through the BOP. Seal 48 maintains sealed engagement between the ram shaft 14 and the door 20 during reciprocation of the ram within the housing 26. Seal 50 provides a static seal between the front end of the housing 26 and the door 20.

Each of the actuator assemblies includes a ram piston 24 which reciprocates along the central ram axis 16 within the ram housing 26. The ram shaft 14 mechanically interconnects the ram piston 24 with the replaceable ram block 12. For sealing an annulus about the oilfield tubular, a properly sized ram block 12 may thus be mounted on a respective ram shaft 14 of each actuator assembly for sealing with the oilfield tubular to seal off a flow path between the BOP body and the oilfield tubular. Alternatively, conventional shearing ram blocks may be mounted on the end of ram 14 to shear through an oilfield tubular then completely close off the flow path through the BOP body. The BOP may include a pair of opposing upper actuator assemblies and a pair of lower actuator assemblies with identical ram blocks if redundant operation is desired. Alternatively, the upper set of ram blocks may be provided for sealing about one size oilfield tubular, while the lower set of ram blocks may be actuated for sealing about a different size oilfield tubular. In yet another embodiment, the lower first ram blocks may be intended for sealing about the annulus between the oilfield tubular and the BOP body, while the upper second set of ram blocks are intended to shear the oilfield tubular and completely close off any fluid or gas flow through the BOP. Each of the pair of opposing upper and lower actuator assemblies will thus be separately controlled.

Figure 2:
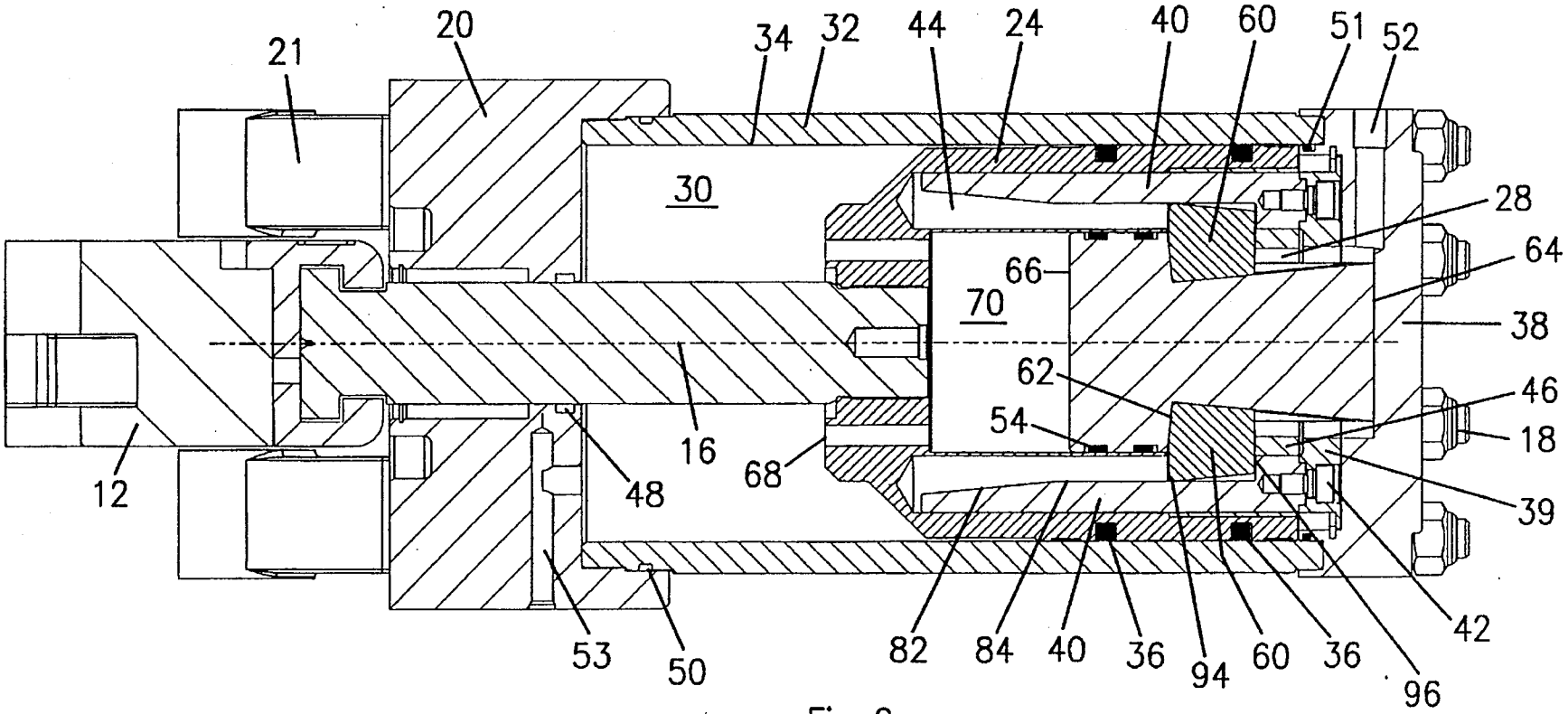
FIG. 2 is a cross-sectional view of the portion of the blowout pressure as shown in FIG. 1, illustrating the actuation mechanism within the ram housing in the ram opened position.
Figure 3:
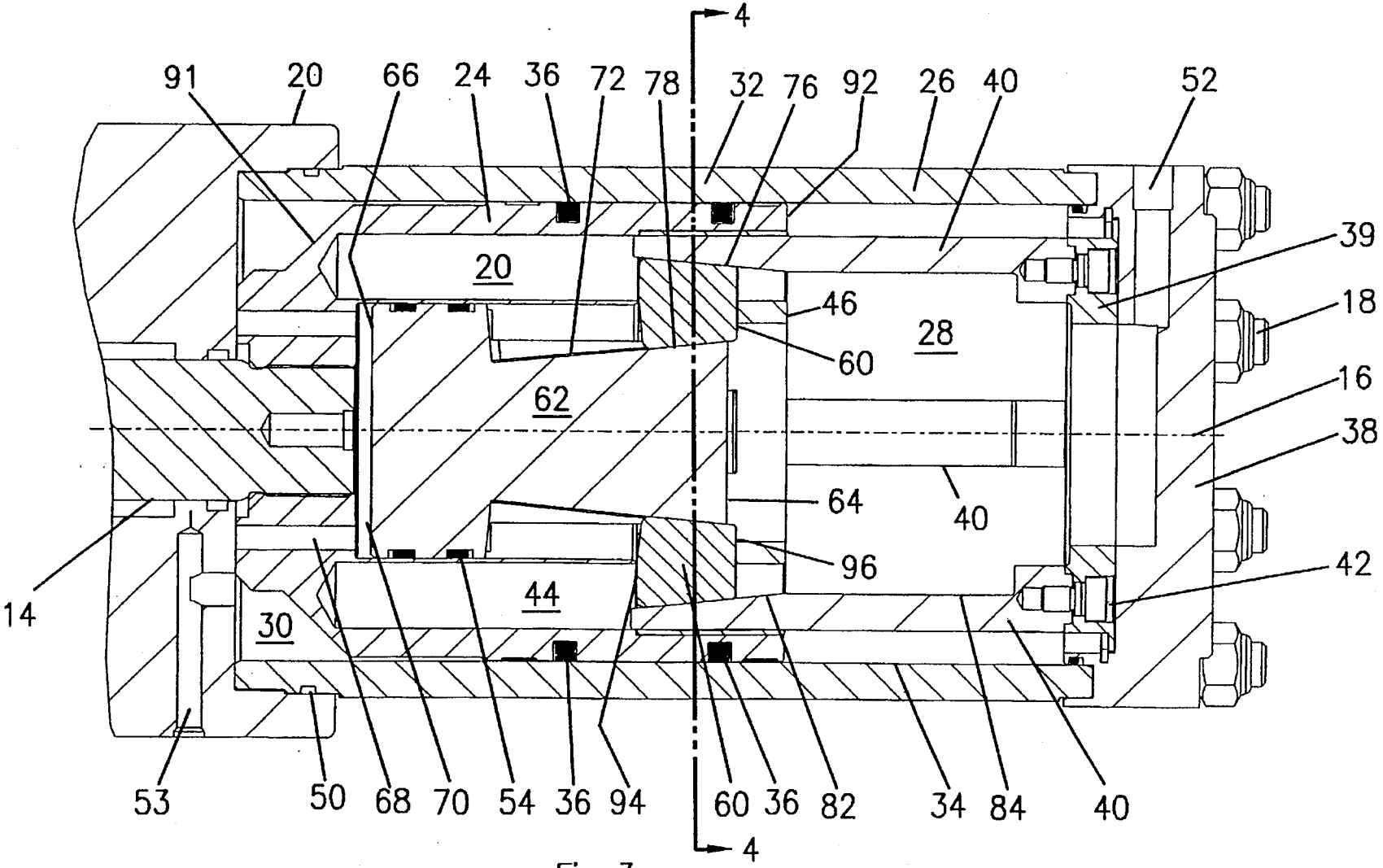
FIG. 3 is a cross-sectional view illustrating the ram housing as shown in FIG. 2 with the actuating mechanism in the ram closed position.

FIG. 2 shows the actuating member in the fully opened position, and FIG. 3 illustrates the same actuating assembly in the fully closed position. Each actuator is fluid powered, and conventional hydraulic fluid rather than air is used as the fluid medium to obtain the high closing forces desired. Pressurized fluid in the ram closing chamber 28 of the actuator assembly 10 moves the ram piston 24 and the ram block 12 structurally connected therewith to the ram closed position. Once the ram locking mechanism as discussed subsequently has been deactivated, pressurized fluid in the ram opening chamber 30 move the ram piston 24 and thus the ram block to the opened position.

FIGS. 1, 2 and 3 depict the ram housing 26, which comprises a generally sleeve-shaped cylindrical portion 32 with an internal cylindrical surface 34 for sealing engagement with one or more seals 36 on the ram piston 24. The inner cylindrical surface 34 of housing portion 32 is thus symmetrically formed about the central ram axis 16. The housing 25 further includes head plate 38 which cooperates with the cylindrical portion 32 and the door 20 to form the cavities 28 and 30 therebetween, with their cavities being fluidly separated by the ram piston 24. A conventional static seal 51 seals between housing portion 32 and head plate 38.

A plurality of conventional threaded securing bolt and nut components 18 may be provided exterior of the sleeve-shaped cylindrical portion 32 for interconnecting the head plate 38 with the door 20. A mounting ring 39 may be fixed to the head plate 38 by similar conventional securing bolts (not shown). A plurality of locking rods 40 each are secured at one end to the mounting ring 39 by conventional bolts 42, and each rod 40 is preferably spaced a uniform distance from and is symmetrically positioned about the central axis 16. In a preferred embodiment, four locking rods 40 are provided and are spaced at 90° intervals about axis 16.

Figure 4:
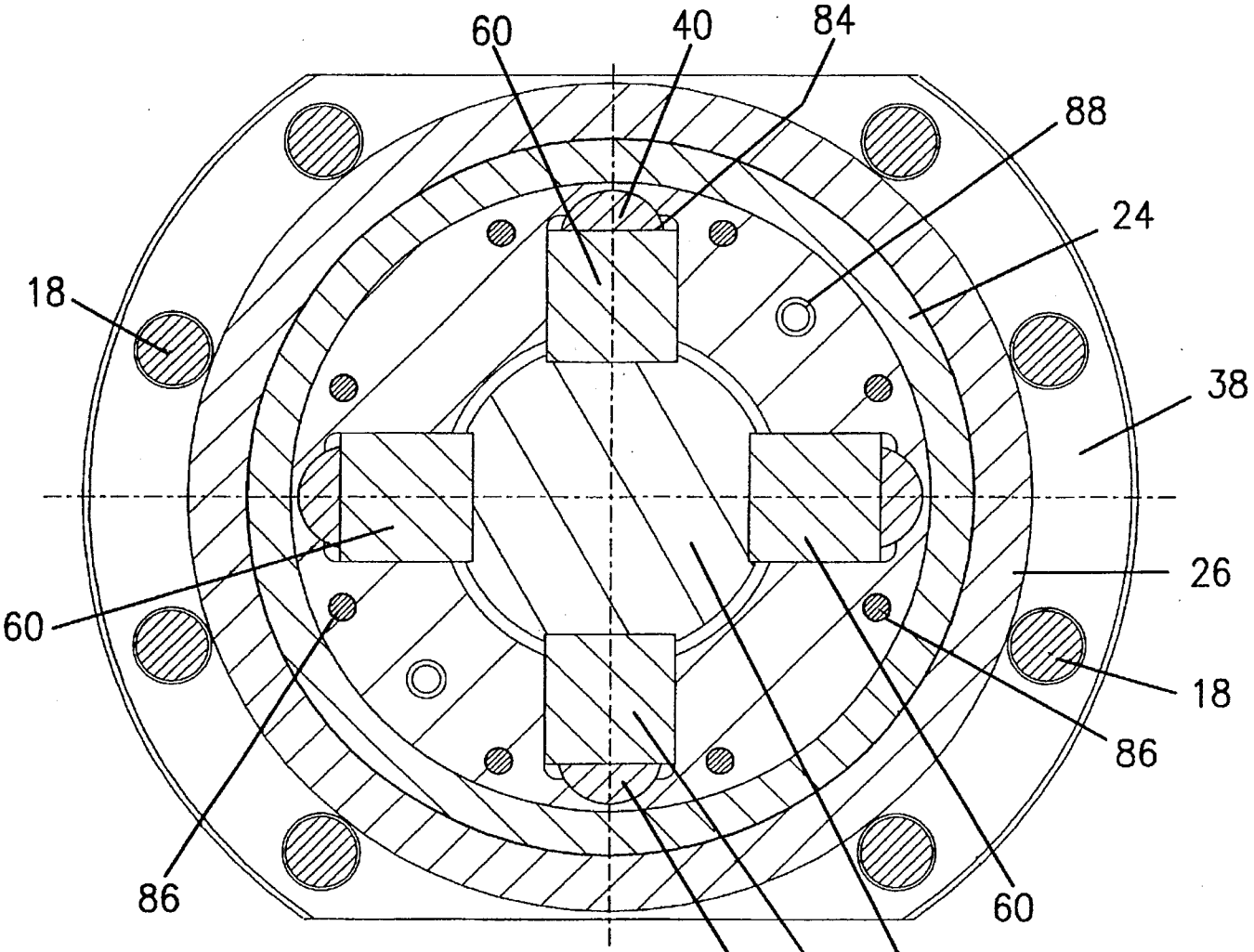
FIG. 4 is a cross-sectional view along lines 4—4 in FIG. 3.

The ram piston 24 is thus axially movable within the housing 26, and includes a plurality of axially extending locking rod cavities 44 therein. Each locking rod cavity 44 is aligned and sized for receiving the cantilevered end of one of the locking rods 40 during reciprocation the ram piston within the housing 26. Retaining plate 46 is fixed to the rear end of the ram piston 24. Retaining plate 46 may be connected to the ram piston 24 by a plurality of circumferentially spaced bolts 86, as shown in FIG. 4. Alignment pins 88 ensure that the plate 46 will be reassembled in the same position on the piston 24.

Each of the rods 40 is thus fixedly secured to the head plate 38 and extends within a respective cavity 44 in the ram piston 24. As shown in FIGS. 2 and 4, each rod 40 has an elongate portion which includes a planar surface 84 which is substantially parallel to the central axis 16, thereby defining a semi-cylindrical cross-sectional configuration for each rod 40. The cantilevered end of each rod includes a radially inward facing planar tapered locking surface 82. Referring to FIGS. 1 and 2, the non-tapered surface 84 allows a locking or wedging segment 60 to slide along the respective rod 40 during the ram closing operation. The retaining plate 46 thus acts as a traveling member to engage each of the segments 60 to move with the ram piston to the ram closed position. Each locking segment 60 is prevented from moving axially toward the door 20 with respect to the ram piston 24 by the stop surface 94 on the ram piston. Each of the locking segments 60 is thus effectively trapped axially between the surfaces 94 and 96 on the ram piston.

The locking piston 62 includes conventional seals 54 for sealing engagement with the interior cylindrical surface 25 of the ram piston 24 (see FIG. 1). Both the ram piston and a locking piston are thus responsive to fluid pressure, but may move independently within the ram housing 26. Closing fluid pressure in the cavity 28 thus acts on the closing end face 92 (see FIG. 3) of ram piston 24, which includes the closing face on the retaining plate 46. Closing fluid pressure also acts on the locking end face 64 of the locking piston 62. The locking piston and the ram piston may thus move as an assembly toward the closed position, with the ram piston 24 pushing the locking segments 60 along the non-tapered surface 84 of a respective locking rod 40. Once each of the locking segments 60 slide into engagement with a respective tapered surface 82 on a locking rod 40, the locking segment 60 is free to move radially outward, and will then slide along the respective surface 72 of the locking piston 62.

Axial travel of the ram piston 24 will be stopped when the head 12 sealingly engages the oilfield tubular or shears through the oilfield tubular, as explained above. If axial travel of the ram piston is not earlier prohibited, the ram piston 24 will engage the door 20, thereby stopping further movement of the ram. The hydraulic pressure in the chamber 28 continues to act upon the locking end face 64 of the locking piston 62, however, thereby driving the locking piston further toward the door 20 and forcing the locking wedges 60 radially outward. Each of the locking wedges thus becomes firmly sandwiched between a respective tapered surface 82 on a locking rod 40 and the tapered surface 72 on the locking piston 62. The locking rod 40 cannot deflect radially outward since it engages the wall of the respective cavity 44 within the ram piston 24, which in turn is supported within the ram housing 26.

The locking mechanism as described above will prevent opening of the ram block even through high forces are applied to the opposing ram heads. In a typical application, the locking mechanism may be designed to withstand an operating pressure within the well in excess of 15,000 psi. The locking mechanism prevents rearward travel or opening of the ram 14 due to the wedging action of the locking mechanism. The locking mechanism as disclosed herein may also be designed to withstand a high axial load in excess of 600,000 lbs on the ram blocks caused by a tool joint being "hung off" or resting on the ram blocks. It should be understood that even if the closing pressure to the chamber 28 is lost, the ram 14 cannot open due to the locking mechanism as described herein. Any force attempting to open the ram block will be transmitted from the ram to the ram piston, which will exert force on the locking segments 60 via stop surface 94 to push the locking segments toward the head plate 38, thereby further driving the locking segments in a wedging manner between the locking surfaces on the locking rods and the locking piston. The actuating mechanism of the present invention will thus allow the ram to be stroked to a closed position, and will lock the ram in the closed position until hydraulic pressure is applied to release the locking mechanism.

To release the locking mechanism and allow opening of the ram bore, hydraulic pressure must be applied to the ram opening chamber 30. Pressure in the chamber 30 will act upon the ram opening face 91 of the ram piston 24, although the ram piston cannot move rearward due to trapped locking segments 60. Fluid pressure in chamber 30 will flow through a passageway 68 in the ram piston 24 to pressurize the chamber 70 between the ram piston and the locking piston, thereby exerting an unlocking force on the unlocking end face 66 of the locking piston 62. This pressure moves the locking piston 62 toward the head plate 38, by allowing the tapered surfaces 72 on the locking piston to slide with respect to the respective locking segments 60. This action releases the wedging force created by the segments 62, so that the ram piston 24 is released to move to its open position.

Each of the tapered surfaces 82 on the locking rod 40 and the tapered surfaces 72 on the locking piston 62 is a planar tapered surface. Each surface 72 and 82 thus lies within a single plane which is inclined at an acute angle with respect to central axis 16. By providing each locking surface within a plane, substantially area contact rather than line contact between each surface and a respective locking segment 60 is achieved. Each surface 72 on the locking piston is inclined at an acute positive locking piston cam angle, meaning that the surface is tapered to decrease the spacing between the ram axis 16 and the locking piston surface 72 when moving axially in a direction toward the ram block. The tapered surface is considered positive since its inclination is configured to force each locking segment 60 radially outward. Each locking surface 82 on a respective locking rod 40 is tapered in an acute negative locking rod cam angle. The surface 82 is thus tapered to increase the spacing between the ram axis 16 and the locking rod surface 82 when moving axially in a direction toward the ram block. The taper on this surface is opposite to the taper of the surface 72, and is considered negative since this surface is inclined to force the locking segments 60 radially inward toward the locking piston 62. Each of the locking surface 72 and 82 is tapered with respect to the central axis 16 at a slight angle of less than 12°, and preferably less than 8°, thereby ensuring that locking segments will become securely trapped by frictional forces between the locking surfaces to perform the desired locking function without any significant slippage. The locking surfaces 72 and 82 may be machined with normal machining finishes, and the mechanism will reliably lock to prevent inadvertent opening of the ram. In the preferred embodiment of the invention, each of the locking surfaces 72 and 82 is inclined with respect to the axis 16 at a positive and a negative cam angle, respectively, each between 5° and 6°. If desired, the cam angle for the locking piston surfaces 72 may be less than the cam angle for surfaces 82, since the surface 72 provides the final locking force on the wedges, as explained above, due to movement of locking piston 62 in response to the closing fluid pressure in chamber 28.

Each of the locking segments 60 includes a planar radially exterior surface 76 designed for planar engagement with the planar surface 82, and a planar radially interior surface 78 designed for planar engagement with planar surface 72. Planar contact between these engaging surfaces thus allows high forces to be transmitted to create the desired wedging action for the locking mechanism without galling or damaging the locking mechanism components.

Each of the locking segments 60 is continually spaced radially between a locking rod and a respective planar tapered surface 72 on the locking piston 62. The locking segments 60 also function to prevent rotation of the locking piston 62 with respect to the ram housing 26. The "free floating" locking segments 60, which may move slightly in any direction with respect to both the locking piston 62 and the ram piston 24, thus automatically and continually center the circumferential orientation of the tapered surfaces 72 with respect to the stationary surfaces 82.

Each locking segment has a planar exterior surface 76 for planar engagement with tapered surface 82. The axial length of surface 76 will depend upon the forces applied to the locking mechanism and the desired contact area between each locking segment and both the locking rod and the locking piston. The locking mechanism of this invention preferably has the ability to lock in an infinite number of locking positions over a relatively wide locking range, so that the actuating mechanism will need little or no adjustment even though the packing material in the ram block changes the preferred axial locking position. Preferably the fixed tapered locking surfaces 82 each have an axial length at least 4 cm longer than the axial length of the respective surface 76, thereby ensuring a reasonably broad locking range. The axial length of the tapered surfaces 72 may be longer than surfaces 82, and preferably may be about twice as long as the surface 76 plus at least 4 cm.

The locking device of the present invention is automatic and no operator interaction is required to perform the locking function. Locking segments 60 are able to lock in any one of an infinite number of positions within a reasonably broad locking range. The locking mechanism of the present invention is relatively simple yet highly rugged, and includes few moving parts. The locking piston 62 performs a function of both assisting in the locking, and moves to allow the unlocking of the mechanism. The number of locking segments 60 will depend on the number of rods 40. No springs or other biasing members are required to force the locking segments 60 into locked engagement between the locking surfaces.

In operation, ram blocks of selected type and size are secured to the ends of the opposing rams 14 in a conventional manner for achieving their desired purpose of either sealing a flow path through the BOP once the actuators are closed, or for shearing an oilfield tubular within the BOP and sealing pressure below the BOP. To close the BOP, pressurized fluid is passed through the ram closing line 52 in the head plate 38 and into the chamber 28 to move the ram piston 24 to its closed position. Alternatively, a hydraulic fluid line extending into the door 20 may be fluidly connected to a ram closing flow line in the head plate 38 by a conduit adjacent but exterior of housing 26 (not shown). During closing, the wedge segments 60 are moved toward the door by engagement with the retaining plate 46. During this closing operation, the locking piston 62 will also be moved toward the closed position as shown in FIG. 3 either by engagement with the wedge segments 62, or in response to fluid pressurize directly acting on the locking end face 64 of the locking piston 62. The locking segments 60 are axially trapped between the ram piston body and the retaining plate 46. Once travel of the ram piston 24 and the locking segments 60 stops, hydraulic pressure within the chamber 28 will continue to act upon the locking piston 62 to force the wedging segments 60 radially outward, thereby further locking the locking segments 60 in place. The locking segments thus automatically move to a locking position upon the application of hydraulic fluid to the closing chamber 28.

When high opening forces are applied to the ram shaft 14 in an attempt to open the BOP, the locking segments 60 and automatically prevent the ram piston 24 and the ram shaft 14 from moving back toward an opening position due to locked engagement of the wedge segments 60 between the camming surfaces 72 and 82. The ram shaft thus remains in its locked position, so that the actuator mechanism 10 serves its desired function of sealing the well fluids. Once closed, the actuator mechanism 10 will remain in its closed position regardless of whether fluid pressure in the chamber 28 is maintained. A high axial opening force transmitted through the ram shaft 14 will thus be transmitted through the ram piston 24 to act upon the locking segment 60 and increase the locking force between the locking piston 62 and the plurality of locking rods 40.

To open the actuator assembly 10, fluid pressure is vented from the chamber 28. Fluid pressure is applied to the chamber 30 through the ram opening flow line 53 in the door 20, and thus to the chamber 70 via the unlocking piston flow line 68 in the ram piston. Pressurized fluid in the chamber 30 cannot initially move the ram piston 24 to an open position due to the interference provided by the locking segments 60. Pressurized fluid in the chamber 70 will, however, move the locking piston 62 to an unlocked position, thereby disengaging the wedging action between the tapered cam surfaces 72 and the locking segments 60. This action will release the locking segments 60 from wedging engagement with the locking rods, thereby allowing the ram piston 24 to move to its opened position. It is a feature of the present invention that the same pressurized fluid acts on both the locking piston 62 and on the ram piston 24 to move the ram piston to its open position.

Various modifications may be made to the embodiments disclosed above without departing from the scope of the invention. For example, it is possible to eliminate the locking rods 40, and instead provide a plurality of circumferentially spaced planar tapered locking surfaces on the housing 26, with the wedge segments 60 thus acting between the locking piston 62 and the fixed surfaces on the housing 26. The previously disclosed embodiment is preferred, however, since the design as shown in the figures allows the utilization of a cylindrical interior surface on the housing continuously between the door 20 and the cylindrical head 38. The modified embodiment discussed would require planar tapered surfaces being formed on the interior surface of the housing 26, and would require assurances that the ram piston seals could not travel to engage the tapered interior surfaces on the cylindrical housing. According to the another embodiment, a single rod may be fixed to the cylinder head 38 and be axially centered with respect to the central axis 16. This single fixed rod may have a plurality of circumferentially spaced planar tapered locking surfaces spaced about the exterior thereof. The locking piston may then be a sleeve-shaped member movable with respect to the fixed locking rod, with the wedge segments being sandwiched between the sleeve-shaped locking piston and the fixed locking rod. The ram piston could be secured at its front end to the ram shaft, and may have a sleeve-shaped rearward end to fit in the annulus between the locking piston and the housing. In the preferred embodiment, the locking rods are secured to the cylinder head which defines the ram closing chamber. Alternatively, the locking, rods could be mounted within the housing and secured to the door which defines the ram opening chamber. The locking rods preferably have a generally semi-cylindrical cross-sectional configuration, although other cross-sectional configurations may be used to form the radially inward non-tapered planar surface and the tapered planar surface on each locking rod.

One of the features of the present invention is that existing BOP actuators may be retrofitted to include the actuating mechanism of the present invention. Since both the actuating and locking components are housed within the conventional housing 26, the size of the blowout preventer need not be increased. Those skilled in the art will appreciate that the various fluid flow lines supplying opening and closing pressure to the chambers 28 and 30, as well as the unlocking piston flow line, may be positioned and configured in various ways to accomplish the purposes of the invention.

Those skilled in the art will appreciate that traveling members other than the retaining plate 46 discussed above may be used for engaging the locking segments to move to the locked position. The stop surface 94 on the ram piston engages the locked segments to prevent premature opening of the ram, although other mechanisms for cooperating between the locking segments and the ram piston could be employed for this purpose. Although axial movement between the locking piston and the locking segments is desired, the tapered surfaces 72 on the locking piston could be extended for functioning as a traveling member to move the locking segments to the locked position.

The foregoing disclosure and description of the invention are thus illustrative and explanatory, and various changes in the methods of operation as well as in the details of the illustrated apparatus may be made within the scope of the appended claims without departing from the present invention.

What is claimed is:

1. A blowout preventer ram actuating mechanism for controlling the opening and closing of a ram block interconnected with a ram movable within a ram housing and along a ram axis between opened and closed positions, the ram actuating mechanism comprising:

a ram piston secured to the ram and axially movable within the ram housing, the ram piston having a ram closing end face and an axially opposing ram opening end face;

a ram closing flow line for applying fluid pressure to the ram closing end face of the ram piston to move the ram block to the closed position;

a ram opening flow line for applying fluid pressure to the ram opening end face of the ram piston to move the ram block to the opened position;

a locking piston sealing engaging the ram piston and movable along the ram axis in response to fluid pressure, the locking piston having a locking end face, an axially opposing unlocking end face, and a plurality of substantially planar tapered locking piston surfaces circumferentially spaced about an exterior of the locking piston and each inclined at an acute positive locking piston cam angle;

an unlocking piston flow line for applying fluid pressure to the unlocking face of the locking piston to move the locking piston to an unlocked position;

a plurality of locking rods each secured to the ram housing and circumferentially spaced about the locking piston, each locking rod including a substantially planar tapered locking rod surface thereon inclined at an acute negative locking rod cam angle; and a plurality of locking segments each spaced radially between a respective locking rod and the locking piston, each locking segment being sandwiched between a respective planar locking rod surface and a planar locking piston surface for preventing opening of the ram until the locking piston is moved in response to fluid pressure in the unlocking piston flow line.

2. The blowout preventer ram actuating mechanism as defined in claim 1, wherein:

the ram piston includes a retaining plate spaced axially opposite the ram block with respect to the plurality of locking segments for engaging the plurality of locking segments to move to a locked position in response to movement of the ram piston within the ram housing; and each locking rod including a sliding surface axially spaced opposite the ram block with respect to the corresponding tapered locking rod surface, the sliding surface being substantially parallel to the ram axis to slidingly engage a respective locking segment when moved to a locked position.

3. The blowout preventer ram actuating mechanism as defined in claim 1, wherein:

the ram housing includes a sleeve-shaped cylinder portion for sealing engagement with the ram piston and a cylinder head plate removably affixed to the sleeve-shaped cylinder portion;

the ram piston includes a plurality of circumferentially arranged locking rod cavities therein; and each of a plurality of locking rods includes a fixed end secured to the cylinder head plate and a cantilevered end extending within a respective locking rod cavity in the ram piston.

4. The blowout preventer ram actuating mechanism as defined in claim 1, further comprising:

each of the plurality of locking segments is radially spaced between a respective locking rod and a respective tapered locking piston surface for continuously preventing rotation of the locking piston with respect to the ram housing.

5. The blowout preventer ram actuating mechanism as defined in claim 1, wherein the acute negative locking rod cam angle for each of the locking rod surfaces is tapered to increase the spacing between the ram axis and the locking rod surface when moving axially toward the ram block and is inclined at an angle of less than 12°.

6. The blowout preventer ram actuating mechanism as defined in claim 5, wherein the acute positive locking piston cam angle for each of the plurality of locking piston surfaces is tapered to decrease the spacing between the ram axis and the locking piston surface when moving axially toward the ram block and is inclined at an angle of less than 12°.

7. The blowout preventer ram actuating mechanism as defined in claim 1, wherein:

each of the plurality of locking segments includes a planar radially exterior surface for substantial planar engagement with a respective locking rod surface; and each of the plurality of locking segments includes a planar radially interior surface for substantially planar engagement with a respective locking piston surface.

8. The blowout preventer ram actuating mechanism as defined in claim 1, wherein:

each of the locking segments has a planar exterior surface for engagement with a respective locking rod surface; and each of the plurality of locking rod surfaces and each of the plurality of locking piston surfaces has an axial length at least 4 cm longer than an axial length of the respective locking segment planar exterior surface.

9. The blowout preventer ram actuating mechanism as defined in claim 1, wherein the plurality of locking rods includes at least four locking rods each secured to the ram housing and uniformly spaced about the circumference of the locking piston a uniform radial spacing from the ram axis.

10. The blowout preventer ram actuating mechanism as defined in claim 1, wherein the unlocking piston flow line passes through the ram piston, such that fluid pressure applied to the ram opening end face of the ram piston simultaneously is applied to the unlocking face of the locking piston to commence opening of the ram block upon movement of the unlocking piston.

11. A hydraulic actuating mechanism for controlling closing of a ram block interconnected with a ram movable within a ram housing of a blowout preventer to control the flow of well fluids through the blowout preventer, the ram actuating mechanism comprising:

a ram piston secured to the ram and axially movable between opened and closed positions within the ram housing in response to fluid pressure;

a locking piston movable within the ram housing along the ram axis in response to fluid pressure, the locking piston having an axially inward unlocking end face and a plurality of substantially planar tapered locking piston surfaces circumferentially spaced about the ram axis and each inclined at an acute angle to vary the spacing between the ram axis and the locking piston surface;

a plurality of substantially planar tapered fixed locking surfaces each secured to the ram housing and inclined at an acute angle to vary the spacing between the ram axis and the fixed locking surfaces;

a plurality of locking segments each spaced radially between a respective fixed locking surface and a locking piston surface, each locking segment being positioned for locking between a respective fixed locking surface and a respective locking piston surface for preventing opening of the ram until the locking piston is moved in response to fluid pressure; and a traveling member connected to one of the ram piston and the locking piston for moving the locking segments to a locked position in response to movement of the ram piston and the locking piston within the ram housing.

12. The actuating mechanism as defined in claim 11, wherein:

the ram housing includes a sleeve-shaped cylinder portion for sealing engagement with the ram piston and a cylinder head plate removably affixed to the sleeve-shaped cylinder portion;

the ram piston includes a plurality of circumferentially arranged locking rod cavities therein; and a plurality of locking rods each including a respective fixed locking surface thereon and secured at one end to the cylinder head plate and having an opposing cantilever end extending within a respective locking rod cavity in the ram piston.

13. The actuating mechanism as defined in claim 11, wherein each of the fixed locking surfaces is inclined at a negative angle of less than 12°, and each of the locking piston surfaces is inclined at a positive angle of less than 12°.

14. The actuating mechanism as defined in claim 11, wherein each of the plurality of locking segments includes a planar radially exterior surface for substantial planar engagement with a respective fixed locking surface, and a planar radially interior surface for substantially planar engagement with a respective locking piston surface.

15. The actuating mechanism as defined in claim 11, wherein:

the traveling member includes a retaining member secured to the ram piston and spaced axially opposite the ram block with respect to the plurality of locking segments for engaging the plurality of locking segments to move to the locked position; and the ram piston includes a stop surface thereon for engaging a respective one of the plurality of locking segments to prevent opening of the ram when the locking segments are in the locked position.

16. A hydraulic actuating mechanism for controlling closing of each one of opposing pair of a ram blocks interconnected with a respective ram and movable within a ram housing of a blowout preventer, the ram actuating mechanism comprising:

a ram piston secured to the ram and axially movable between opened and closed positions within the ram housing in response to fluid pressure;

a locking piston sealingly engaging the ram piston and movable within the ram housing along the ram axis in response to fluid pressure, the locking piston having an axially inward unlocking end face and a plurality of substantially planar tapered locking piston surfaces circumferentially spaced about the ram piston and each inclined at a positive locking piston cam angle to decrease the spacing between the ram axis and the locking piston surface when moving axially toward the ram block;

a plurality of locking rods each secured to the ram housing and circumferentially spaced about the locking piston, each locking rod including a substantially planar tapered locking rod surface inclined at an acute negative locking rod cam angle to increase the spacing between the ram axis and the locking rod surface when moving axially toward the ram block; and a plurality of locking segments each spaced radially between a respective locking rod surface and a locking piston surface, each locking segment being sandwiched between a respective locking rod surface and a locking piston surface for preventing opening of the ram until the locking piston is moved in response to fluid pressure.

17. The actuating mechanism as defined in claim 16, further comprising:

the ram piston includes a retaining member spaced axially opposite the ram block with respect to the plurality of locking segments for engaging the plurality of locking segments to move to a locked position in response to movement of the ram piston within the ram housing.

18. The actuating mechanism as defined in claim 16, wherein:

the ram housing includes a sleeve-shaped cylinder portion for sealing engagement with the ram piston and a cylinder head plate removably affixed to the sleeve-shaped cylinder portion;

the ram piston includes a plurality of circumferentially arranged locking rod cavities therein; and each of a plurality of locking rods includes a fixed end secured to the cylinder head plate and a cantilevered end extending within a respective locking rod cavity in the ram piston.

19. The actuating mechanism as defined in claim 16, wherein the acute negative locking rod cam angle for each of the locking rod surfaces is inclined at an angle of less than 12°; and the acute positive locking piston cam angle for each of the plurality of locking piston surfaces is inclined at an angle of less than 12°.

20. The actuating mechanism as defined in claim 16, wherein each of the plurality of locking segments includes a planar radially exterior surface for substantial planar engagement with a respective locking rod surface, and a planar radially interior surface for substantially planar engagement with a respective tapered locking piston surface.

* * * * *